United States Patent [19]

Forrest et al.

[11] 3,998,162

[45] Dec. 21, 1976

[54] MISSILE WARHEADS

[75] Inventors: Thomas Percy Forrest, Chelsfield; William Ernest Soper, West Wickham; Donald McKenzie, Hartley, Dartford, all of England

[73] Assignee: The United States of America as represented by the Secretary of the Army, Washington, D.C.

[22] Filed: Sept. 16, 1958

[21] Appl. No.: 761,442

[30] Foreign Application Priority Data

Sept. 17, 1957 United Kingdom ..... 29324/57

[52] U.S. Cl. ..... 102/56 SC; 102/5; 102/24 HC; 102/DIG. 2

[51] Int. Cl.[2] ..... F42B 13/10

[58] Field of Search ..... 102/58, 7.2, 20, 21.6, 102/34.5, 37.7, 50, 91, 72, 85, 5 HC, 5, 61, 57, 24, 27, 49, 56 SC, 24 HC; 89/1.02

[56] References Cited

UNITED STATES PATENTS

| | | | |
|---|---|---|---|
| 1,991,857 | 2/1935 | Lewis | 102/27 |
| 2,079,008 | 5/1937 | Goss | 102/7.2 |
| 2,359,192 | 9/1944 | Beblo | 102/5 |
| 2,376,227 | 5/1945 | Brown | 102/5 |
| 2,379,252 | 6/1945 | Scott | 102/5 |
| 2,419,854 | 4/1947 | Peterson | 102/5 |
| 2,494,256 | 1/1950 | Muskat et al. | 102/24 HC |
| 2,734,456 | 2/1956 | Sweetman | 102/24 HC |
| 2,819,673 | 1/1958 | Cecil et al. | 89/1 C |
| 2,843,041 | 7/1958 | Stewart | 102/20 |
| 2,941,470 | 6/1960 | Jasse | 102/49.7 |

FOREIGN PATENTS OR APPLICATIONS

| | | | |
|---|---|---|---|
| 38,585 | 7/1936 | Netherlands | 89/1 C |

*Primary Examiner*—Verlin R. Pendegrass
*Attorney, Agent, or Firm*—Nathan Edelberg; Robert P. Gibson

[57] ABSTRACT

A missile warhead having a plurality of lined shaped charges symetrically disposed about the missile axis and arranged in forward, rearward and central banks. The forward bank is directed diagonally forward, the central bank is directed radially and the rearward bank is directed diagonally rearward. Channels of equal length having explosive therein, connect each of the shaped charges to a single initiation point.

3 Claims, 2 Drawing Figures

Inventors,
By Thomas P. Forrest
William E. Soper
Donald McKenzie
W. E. Thibodeau, S. J. Rotondi & A. T. Dupont Inventors,
By Thomas P. Forrest
William E. Soper
Donald McKenzie
W. E. Thibodeau, S. J. Rotondi & A. T. Dupont

MISSILE WARHEADS

This invention relates to missile warheads.

Its object is to provide, (at distances from the target at which the burst point is expected to occur) greater lethality than was provided by earlier blast or fragmentation types of warhead.

The invention therefore provides, in a missile warhead, a plurality of shaped charges directed at various angles to the missile axis, and means for causing substantially simultaneous detonation of the said shaped charges.

The shaped charges are preferably spaced and directed symmetrically with respect to the missile axis. The timing of initiation of the detonation wave in each charge should be so nearly simultaneous and the charges must be so arranged that interference between the jets from the various charges does not occur.

The charge assembly may be initiated by a suitable main fuze, for example of the proximity type and the delay times between initiation of the main initiator and initiation of each of the separate charges must be very nearly identical in order to obtain satisfactory functioning of the warhead. A certain degree of uniformity may be obtained by the use of cordtex to convey the initiation to the charges, but this method is considered impracticable in a service design. A more satisfactory system is the use of separate electrically fired detonators for each charge but, owing to the multiplicity of detonators, involves a greater risk to personnel during the filling operation. A third and preferred method is the use of channels filled with explosive to transmit the detonation from a common point to the separate charges. Provided the channels are of equal length and are filled to give the same order of average detonation velocity throughout the length of each channel, a very high degree of uniformity in delay time may be obtained.

This type of warhead may contain a large weight of explosive and, since only a small proportion of the energy from the explosive is used in forming jets from the shaped charges, will produce, in addition to the jets, a blast wave similar to that from the normal blast type warhead. This blast wave has a velocity considerably lower than that of the jets and will therefore follow them outward from the burst point. This type of warhead will therefore have a lethality, due to the blast wave, similar to that of a normal blast type warhead with additional lethality and penetrative power provided by the jets from the shaped charges.

One form of warhead in accordance with the invention, in which an arrangement of shaped charges is used, will now be more particularly described by way of example only, with reference to the accompanying drawings in which.

Figure 1:
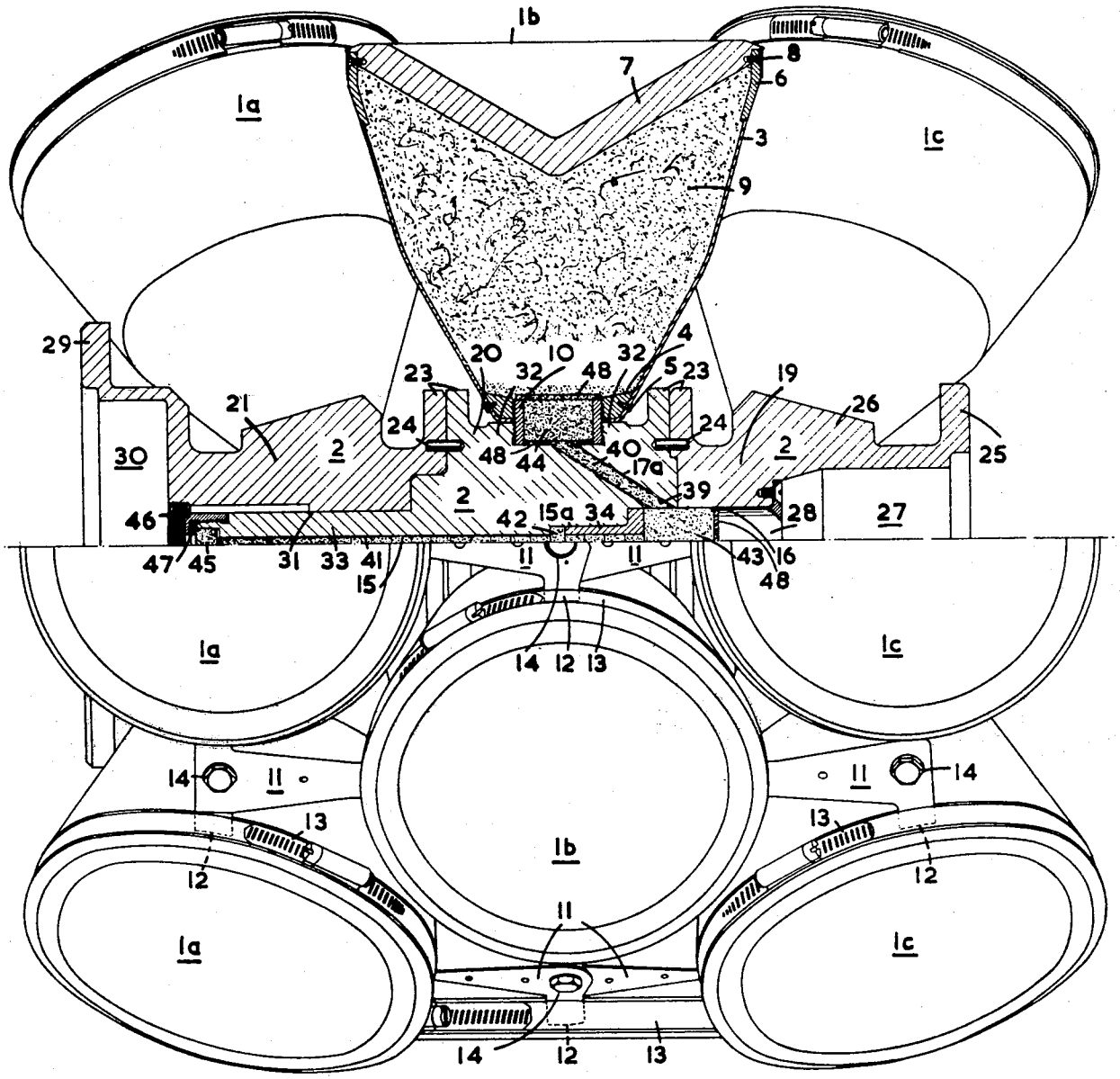
FIG. 1 is a half sectional elevation of a warhead.

As shown in FIG. 1 the warhead contains three banks of six shaped charges 1*a*, 1*b*, 1*c* attached to a central metal block 2 whose axis lies along the longitudinal axis of the warhead. The charges 1*a*, 1*c* in the forward and rearward banks are respectively directed forwardly and rearwardly along equi-spaced generators of cones, the axes of which cones coincide with the longitudinal axis of the warhead, and are preferably so arranged that each of three equi-spaced axial planes of the warhead contains the axes of four charges, two of the forward and two of the rearward bank. The charges 1*b* of the central bank are directed along equi-spaced radii of a plane perpendicular to the warhead axis and are preferably so arranged that their axes bisect the angles between the planes containing the axes of the charges in the forward and rearward banks. This arrangement enables a large zone to be covered by the multiplicity of jets and gives adequate coverage to allow for missile fuzing errors.

Each shaped charge comprises a cup-shaped container 3 having a hole in its smaller, inner end adjacent the block 2. Within the inner end of the container 3 is an internally threaded collar 4 shaped to fit the contour of the container 3 and attached thereto by screws 5. The collar may, if desired, be attached by other means or made integral with the container. The outer end of the container 3 is welded to a rim 6 to which a shaping cone 7 is attached by screws 8 or by other suitable means. The container 3 has a suitable high explosive filling 9. The charges are so shaped to carry a large volume of explosive within the available space but the shape and design of the individual charges may be varied at will within the scope of the invention. Each charge is attached to the central block 2; the threaded collar 4 being screwed onto a short tube 10 which in turn is screwed into a recess in the block 2. The outer ends of the charges are restrained from relative movement by metal spacers 11 having upturned tabs 12 to which the charges are attached by means of hose clips 13 fastened round the rims 6 over the tabs 12. Adjacent spacers 11 which may be of any convenient shape are bolted together by bolts 14.

The central metal block 2 has an axial channel 15 drilled therein extending from the front end face partway through the block. At the inner or rearward end of this channel is a small chamber 16 of larger diameter from which twelve diagonal channels 17, 17*a* radiate to the inner ends of the tubes 10 to which are attached the twelve spaced charges 1*b*, 1*c* comprising the rearward and central banks. A further six channels 18 extend from a point on the axial channel and are directed in the first place radially outward, then longitudinally forward and finally diagonally outward to the inner ends of the tubes 10 to which are attached the charges 1*a* forming the forward bank. The arrangement is such that the lengths of the paths from the forward open end of the axial channel to the eighteen charges are identical.

The channels in the central block are filled with a suitable high explosive and are arranged to be initiated at the forward end of the axial channel 15 by the missile fuze (not shown) which may conveniently be of the proximity type. After initiation the detonation travels through the explosive filled channels to the shaped charges which detonate very nearly simultaneously.

In order to facilitate the drilling of the aforementioned channels the central block 2 is preferably built up of three transverse sections 19, 20, 21 which are separately drilled and then bolted together, each section being arranged to carry one bank of charges. This arrangement has the further advantage that the central section 20 which contains the longitudinal forward portions of the channels 18 to the forward bank of charges 1*a* in close proximity to the axial channel 15 may be made of steel to improve confinement and ensure transmission of the detonation wave around the bends and to reduce risk of sympathetic detonation between the channels 15 and 18, while the two end sections may be made of aluminum or a light alloy to reduce the overall weight of the warhead.

In the arrangement shown the central block 2 comprises a rearward section 19, a central section 20 and a forward section 21, held together by bolts 22 through flanges 23 and located relative to one another by dowels 24.

The rearward section 19 has a rearward flange 25 for attachment to the missile and an intermediate portion 26 whose external shape is a frustum of a hexagonal pyramid each face of which has an internally threaded recess for the reception of a tube 10 as hereinbefore described. The section has a recess 27 at its rear end to reduce its weight and an axial bore extends from the recess to the forward face of the section the forward part of the bore forming part of the chamber 16 and its rearward part being closed by a plug 28. The section 19 carries the six diagonal channels 17 extending from the chamber 16 to the inner ends of the tubes 10 which carry the rearward bank of charges 1*c*.

The forward section 21 is similar in external shape to the rearward section 19 and has a forward flange 29 for attachment to the missile and a forward recess 30 for the reception of an initiator. This section carries the diagonal portions of the channels 18 to the forward bank of charges and has a central bore 31. The tubes 10 carried by the forward section 21 are aligned longitudinally with those carried by the rearward section 19. The central section 20 has an intermediate portion 32 whose external form is substantially a hexagonal prism axially aligned with the pyramidical parts of the sections 19 and 21 but angularly displaced by 30° therefrom. Each face of the prism has a recess for the reception of a tube 10. The forward end of the section 20 has a spigot 33 formed thereon which spigot is inserted into the bore 31 of the forward section 21. The axial channel 15 extends through the spigot 33 and the body of the section 20 having a counterbore 15*a* near its rearward end and terminating in a recess in the rear face of the section 20 which recess together with part of the bore of the rearward section 19 forms the axial chamber 16. The counterbore 15*a* has a liner 34 therein extending from the chamber 16 to a short distance from the inner end of the counterbore 15*a*. Extending radially outward from the inner end of the counterbore 15*a* are six short radial channels forming the radial parts of the channels 18, these radial channels may be formed by drilling from the surface to intersect the axial channel and sealing the outer parts of the bores by means of plugs 35 held in position by screws 36. Six longitudinal channels forming the longitudinal parts of the channels 18 communicate between the radial channels and the diagonal channels in the forward section 21. These longitudinal channels may be formed by boring through the section 20 on lines intersecting the radial channels and sealing the parts of the bores rearward of the radial channels by means of plugs 37 held in position by screws 38. The central section 20 also carries the six diagonal channels 17*a* (FIG. 1) communicating between the chamber 16 and the charges in the central bank.

Filling of the channels is an important operation since the uniformity in travel of the detonation will depend on the uniformity of the filling. Stemming with tetryl is not very satisfactory owing to the configuration of the channels which makes this method difficult to carry out. Filling with a plastic explosive is a convenient method but plastic explosive has a high expansion coefficient and tends to exude oil at elevated temperatures. It is therefore not satisfactory for warheads which are required to be stored, particularly in warm climates. A preferred method is to fill all channels except the diagonal portions with prepressed tetryl pellets and to insert into the diagonal portions thin light alloy tubes 39 which have previously been filled with a cast, or otherwise suitably shaped explosive 40, for example RDX/TNT (cyclotrinethylene-trinitramine/-tri-nitro-tolunene). The ends of the tubes 39 and their fillings 40 are cut diagonally to give good contact with adjacent tetryl pellets. The narrow parts of the longitudinal and radial channels are filled with small tetryl pellets 41 a slightly larger pellet 42 being inserted at the inner end of the counterbore 15*a* of the central channel 15 from which point the channels 18 radiate. The pellet 42 is inserted before insertion of the liner 34. A large tetryl pellet 43 is inserted into the chamber 16 from which the diagonal channels 17, 17*a* radiate and large pellets 44 are inserted into the tubes 10 to which the charges are attached. At the forward end of the central channel 15 at which point the explosive train is initiated is a tetryl pellet 45 somewhat larger than those within the channel this pellet 45 being held in position by a cap 46 screwed over the end of the spigot 33, a felt washer 47 being inserted between the cap and the pellet both cap and pellet having orifices therein. Felt washers or discs 48 are inserted on both sides of the pellets 44 in the tubes 10 and between the plugs 35, 37 and 43 and the adjacent pellets. This method has been shown to give very good uniformity in time of initiation of detonation in the shaped charges.

Figure 2:
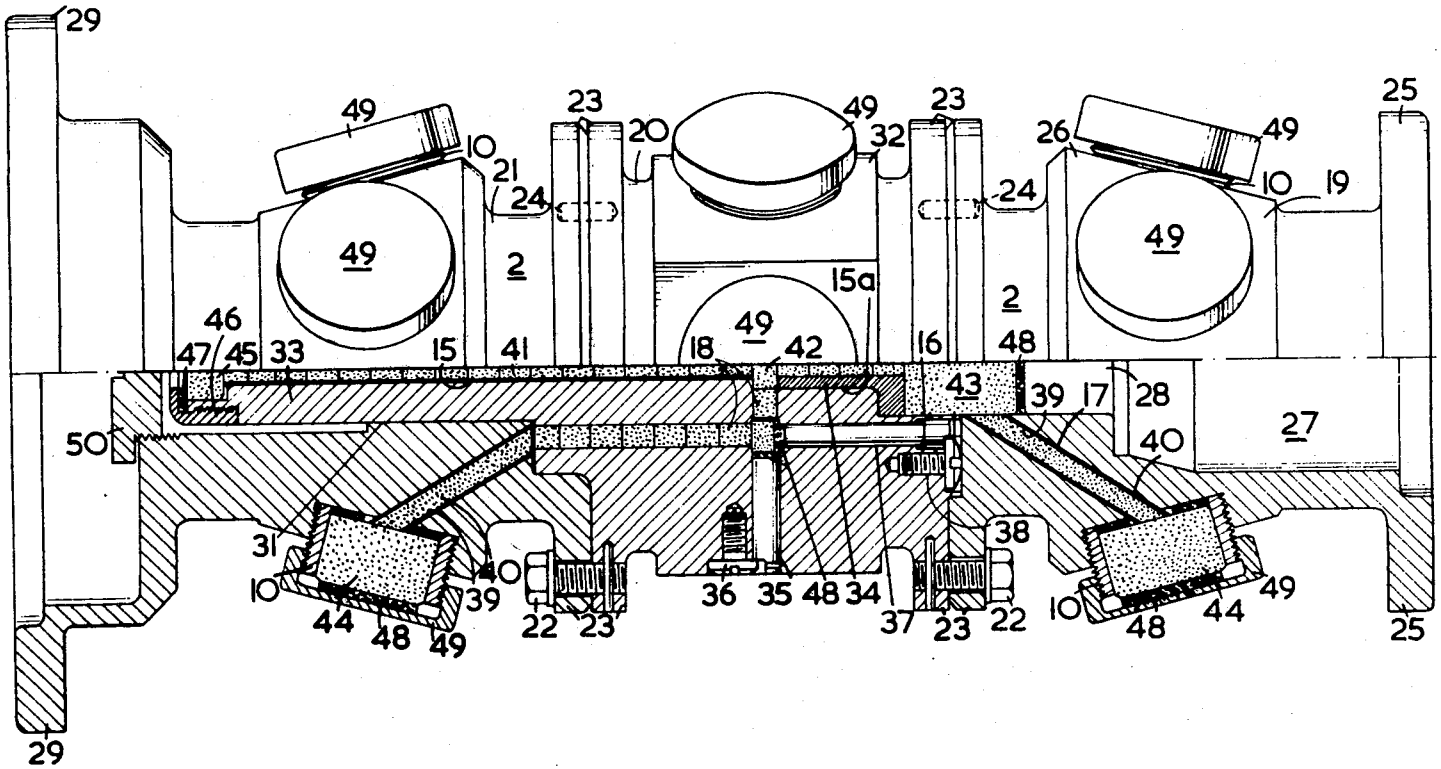
FIG. 2 is a half sectional elevation of the central block to which the charges are attached, the section being in a plane at 30° inclination to the plane of the Section in FIG. 1.

For ease and safety of transport the charges may be detached from the central block 2, the tubes 10 being closed by caps 49 and the forward end of the central channel 15 being closed by a plug 50 as shown in FIG. 2.

The particular arrangement of shaped charges used in the example described need not necessarily be followed. The charges may be arranged in any suitable manner and may, if desired, be arranged in one or more groups so directed that greater or even exclusive coverage is given over one or more selected zones. For example the charges may be grouped around the missile axis and aimed forwardly or diagonally forward to cover a conical zone ahead of the point of burst.

We claim:

1. A missile warhead having a plurality of lined shaped charges symmetrically disposed about the missile axis and arranged in three banks, a forward bank the charges in which are directed diagonally forward; a central bank the charges in which are directed radially and a rearward bank the charges in which are directed diagonally rearward with respect to the missile axis; a central metal block to which the charges are attached and within which in a system of branching channels which channels comprise an axial channel extending into the block from an initiation point at its forward end, diagonal channels extending from the rearward end of the axial channel one to each charge in the central and rearward banks and channels extending from an intermediate point of the axial channel first radially outward, then longitudinally forward and finally diagonally forward, one to each charge in the forward bank, the distances along the channels from the initiation point to the charges being equal; a filling of tetryl pellets within the longitudinal and radial parts of the channels; a thin metal tube within each diagonal channel and a filling of an explosive composition within each thin metal tube.

2. A missile warhead comprising eighteen shaped charges arranged in three banks each containing six charges symmetrically disposed about the missile axis, a forward bank the charges in which are directed diagonally forward, a rearward bank the charges in which are directed diagonally rearward and each aligned longitudinally of the missile with a charge of the forward bank and a central bank the charges in which are directed radially outward and are staggered circumferentially with respect to the charges of the forward and rearward banks; spacers connecting the outer ends of the charges for restraining the charges from relative movement; a central metal block comprising three sections, a forward section within which is an axial bore, a central portion to the forward section of hexagonal frusto-pyramidical form to each face of which portion is attached one charge of the forward bank, a rearward section having a recess in its forward face, a central portion to the rearward section of hexagonal frusto-pyramidical form to each face of which portion is attached one charge of the rearward bank and a central section, a spigot extending forwardly from the central section through the bore of the forward section and a central portion to the central section of hexagonal prismatic form to each face of which is attached one charge of the central bank, flanges on each section for attachment by bolts to the adjacent section; the central section being provided with an axial channel extending from the forward end of its spigot to the rear face of the section, six diagonal channels extending from the rear end of the axial channel forwardly to the charges of the central bank and six other channels extending from an intermediate point on the axial channel first radially outward and then longitudinally forward to the forward face of the central section, the forward section being provided with six diagonal channels extending from the forward end of the longitudinal parts of the channels in the central section to the charges of the forward bank, and the rearward section being provided with diagonal channels extending to the charges in the rearward bank from the recess in its forward face which recess is aligned with the axial channel in the central section; a train of tetryl pellets filling the longitudinal and radial portions of the channels in the central section and the recess in the rearward section of the initial block; thin metal tubes lining the diagonal channels in all sections of the block; and a filling of cyclotrinethylene-trinitramine trinitro-toluene within the said thin metal tubes.

3. A missile warhead having a plurality of lined shaped charges arranged in three banks, each bank of charges directed at a different angle from the missile axis, a metal block having banks of shaped charges attached thereto, branching powder channels within the metal block containing branching explosive trains, said explosive trains connecting each bank of shaped charges to a single initiation point, said channels being of equal length and the explosive so arranged that the average detonation velocity in each channel is substantially the same after impact.

* * * * *